US005163784A

United States Patent [19]

Kunito

[11] Patent Number: 5,163,784

[45] Date of Patent: Nov. 17, 1992

[54] DOUBLE-TUBE TYPE BORING AND KNEADING MACHINE, AND METHOD FOR IMPROVING FOUNDATION GROUND THEREWITH

[75] Inventor: Mitsuhiro Kunito, Kishiwada, Japan

[73] Assignee: Kabushiki Kaisha Ask Kenkyusho, Osaka, Japan

[21] Appl. No.: 637,901

[22] Filed: Jan. 4, 1991

[30] Foreign Application Priority Data

Jan. 11, 1990 [JP] Japan ..... 2-5478
Jan. 11, 1990 [JP] Japan ..... 2-5479
Jan. 11, 1990 [JP] Japan ..... 2-5480

[51] Int. Cl.[5] ..... E02D 3/12

[52] U.S. Cl. ..... 405/263; 405/266; 405/269

[58] Field of Search ..... 405/267, 266, 269, 263, 405/241, 258

[56] References Cited

U.S. PATENT DOCUMENTS 5,013,185 5/1991 Taki ..... 405/269

FOREIGN PATENT DOCUMENTS 0161974 11/1985 European Pat. Off. ..... 405/241
0037220 3/1983 Japan ..... 405/267
0050217 3/1983 Japan ..... 405/269
0181919 10/1983 Japan ..... 405/269
1026094 4/1966 United Kingdom ..... 405/241

*Primary Examiner*—Dennis L. Taylor
*Attorney, Agent, or Firm*—Armstrong, Nikaido, Marmelstein, Kubovcik & Murray

[57] ABSTRACT

In a double-tube type boring and kneading machine comprising a double tubular shaft assembly composed of both an outer tubular shaft and an inner shaft separately rotatable to each other, said outer tubular shaft is adapted to be rotated at a high speed and provided at its external surface with a stirring and kneading means, and said inner shaft is adapted to be rotated with a large torque and provided with a boring bit at its leading end, a lower stirring and kneading means and a liquid discharge port. A method for improving a foundation ground by employing a double-tube type boring and kneading machine is also disclosed herein.

9 Claims, 5 Drawing Sheets

DOUBLE-TUBE TYPE BORING AND KNEADING MACHINE, AND METHOD FOR IMPROVING FOUNDATION GROUND THEREWITH

BACKGROUND OF THE INVENTION

1. Field of the Invention

The present invention relates to a double-tube type boring and kneading machine adapted to bore a foundation ground and to knead the soils and sands taken by the boring and mixed with a liquid such as a cement milk, and also relates to a method for improving a foundation ground by employing said double-tube type boring and kneading machine.

2. Prior Art

When conventionally improving a foundation ground (referred to as a weak ground hereinafter) composed of weak soil and sand strata, it is necessary to improve the weak ground together with a portion of an upper section of a tight solid earth or a rock (referred to as a solid ground) below the weak ground. The reason is because landslides often happen at a boundary between the weak ground and the solid ground in case that a stratum including them is inclined. Generally, when improving the weak ground, can be adopted such a method as kneading the soils and sands mixed with the binding liquid by means of a pressure of the liquid spouted from the leading end of of a rotary shaft while the binding liquid is being spouted to the soils and sands in that way. In that case, a sufficient stirring and mixing is not attained because only the pressure of the spouted liquid is utilized. Further, in another method, the boring is carried out while the binding liquid is discharged from the leading end of a rotary shaft, and at the same time the binding liquid and the soils and sands are mixed and kneaded by means of a stirring and kneading wing attached to the rotary shaft. In this case, however, it is necessary to rotate the rotary shaft at a high speed in order to sufficiently knead the soils and sands mixed with the binding liquid. In case that the rotary shaft is rotated at a high speed, the boring capability thereof is decreased and simulatneously it becomes impossible to bore a portion of the upper section of the solid ground. On one hand, in case that the rotary shaft is rotated at a low speed to increase the boring capability, the stirring and kneading becomes insufficient.

As a boring and digging machine capable of sufficiently stirring and kneading as well as keeping the boring capability at a high level, conventionally has been known the one disclosed in Japanese Patent Publication <KOKOKU> No. 01-29930. The double-tube type boring and kneading machine disclosed in Japanese Patent Publication <KOKOKU> No. 01-29930 has a double tubular shaft assembly comprising an outer tubular shaft and an inner shaft which both shafts are separately rotatable. The outer tubular shaft is adapted to rotate at a high speed and is provided only at its lower external surface with a stirring means. The inner shaft is adapted to rotate at a low speed and is provided at its leading end with a bit and a liquid discharge port.

In such a conventional double-tube type boring and kneading machine, since the dug soils and sands and the binding liquid are stirred and kneaded only by a stirring and kneading means attached to the outer tubular shaft, the stirring and kneading is insufficient.

SUMMARY OF THE INVENTION

The present invention is directed to solving the above-mentioned problems. Accordingly, it is an object of the present invention to provide a double-tube type boring and kneading machine and a method for improving a foundation ground by employing said double-tube type boring and kneading machine capable of performing a sufficient stirring and kneading as well as improving a foundation ground without lowering the boring capability thereof to prevent an earth fault slide when both a weak ground and a solid ground are intended to be simultaneously improved.

For accomplishing the above-mentioned object, a double-tube type boring and kneading machine according to the present invention comprising a double tubular shaft assembly 1 composed of an outer tubular shaft 2 and an inner shaft 4 which both shafts 2, 4 being separately rotatable, said outer tubular shaft 2 being adapted to be rotated at a high speed and being provided at its external surface with a stirring and kneading means 3, said inner shaft 4 being adapted to be rotated with a large torque and being provided with a boring bit 5 at its leading end, a lower stirring and kneading means 3' and a liquid discharge port 6.

Herein, said external tubular shaft 2 having the stirring and kneading means 3 may be provided with a port 6 for discharging the liquid.

Further, there may be provided a rotational direction changeover control means 7 for controlling the rotational direction of said double tubular shaft assembly 1 so as to reversely rotate periodically.

A plurality of double tubular shaft assemblies 1 may be arranged therein. In this case, said plurality of double tubular shaft assemblies 1 may be preferably arranged so that portions of the rotation orbits described by the stirring and kneading means 3 of the adjacent double tubular shaft assembies 1 or portions of the rotation orbits described by the lower stirring and kneading means 3' overlap to each other in a plan view.

Then, in a method for improving a foundation ground by employing said double-tube type boring and kneading machine according to the present invention, which machine comprising a double tubular shaft assembly 1 composed of an outer tubular shaft 2 and an inner shaft 4 which both shafts 2, 4 being separately rotatable, said outer tubular shaft 2 being adapted to be rotated at a high speed and being provided at its external surface with a stirring and kneading means 3, said inner shaft 4 being adapted to be rotated with a large torque and being provided with a boring bit 5 at its leading end, a lower stirring and kneading means 3' and a liquid discharge port 6, which method comprising a boring step for boring a foundation ground spouting a binding liquid 8 such as a cement milk and the like thereinto at a hight pressure by means of said double-tube type boring and kneading machine, and a mixing and kneading step for mixing the binding liquid 8 such as the cement milk and the like spouted into the ground with soils and sands and kneading them by means of said stirring and kneading means 3 of said outer tubular shaft 2 and said lower stirring and kneading means 3' of said inner shaft 4.

The liquid discharge port 6 is provided in the inner shaft 4 and may be provided also in said outer tubular shaft 2 so that the binding liquid can be discharged from both the port 6 of the inner shaft 4 and the port 6 of the outer tubular shaft 4 when the ground is bored by means of the double-tube type boring and kneading machine and the binding liquid such as the cement milk and the like and the soils and sands are mixed and kneaded in the ground.

Further, when the ground is bored by means of the double-tube type boring and kneading machine and the binding liquid such as the cement milk and the like and the soils and sands are mixed and kneaded in the ground, the double tubular shaft assemby 1 may be reversely rotated periodically during the mixing and kneading operation.

Accordingly, since the outer tubular shaft 2 is rotated at a hight speed and is provided at its external surface with the stirring and kneading means 3 while the inner shaft 4 is rotated with a large torque and is provided with the boring bit 5 at its leading end, the lower stirring and kneading means 3' and the liquid discharge port 6, it is possible to bore both the weak ground and the solid ground by the large torque rotation of the inner shaft 4. Further, when the dug soils and sands and the binding liquid are stirred and kneaded, it becomes possible to carry out the effective stirring and kneading by the high speed stirring and kneading of the stirring and kneading means 3 installed to the outer tubular shaft 2 rotating at a high speed as well as by the low speed stirring and kneading of the lower stirring and kneading means 3' installed to the inner shaft 4 rotating with a large torque.

Then, when the dug soils and sands and the binding liquid are stirred and kneaded by the stirring and kneading means 3 rotating at a high speed as well as the lower stirring and kneading means 3' rotating with a large torque while the binding liquids are discharged from the port 6 provided also in the outer tubular shaft 2 and the port 6 provided in the inner shaft 4 respectively, the more effective stirring and kneading can be carried out.

Further, when the double tubular shaft assembly 1 is reversely rotated periodically during the kneading operation, the more effective stirring and kneading can be carried out.

DETAILED DESCRIPTION OF THE PREFERRED EMBODIMENTS

Now, embodiments of the present invention will be explained with reference to the accompanying drawings hereinafter.

Figure 1:
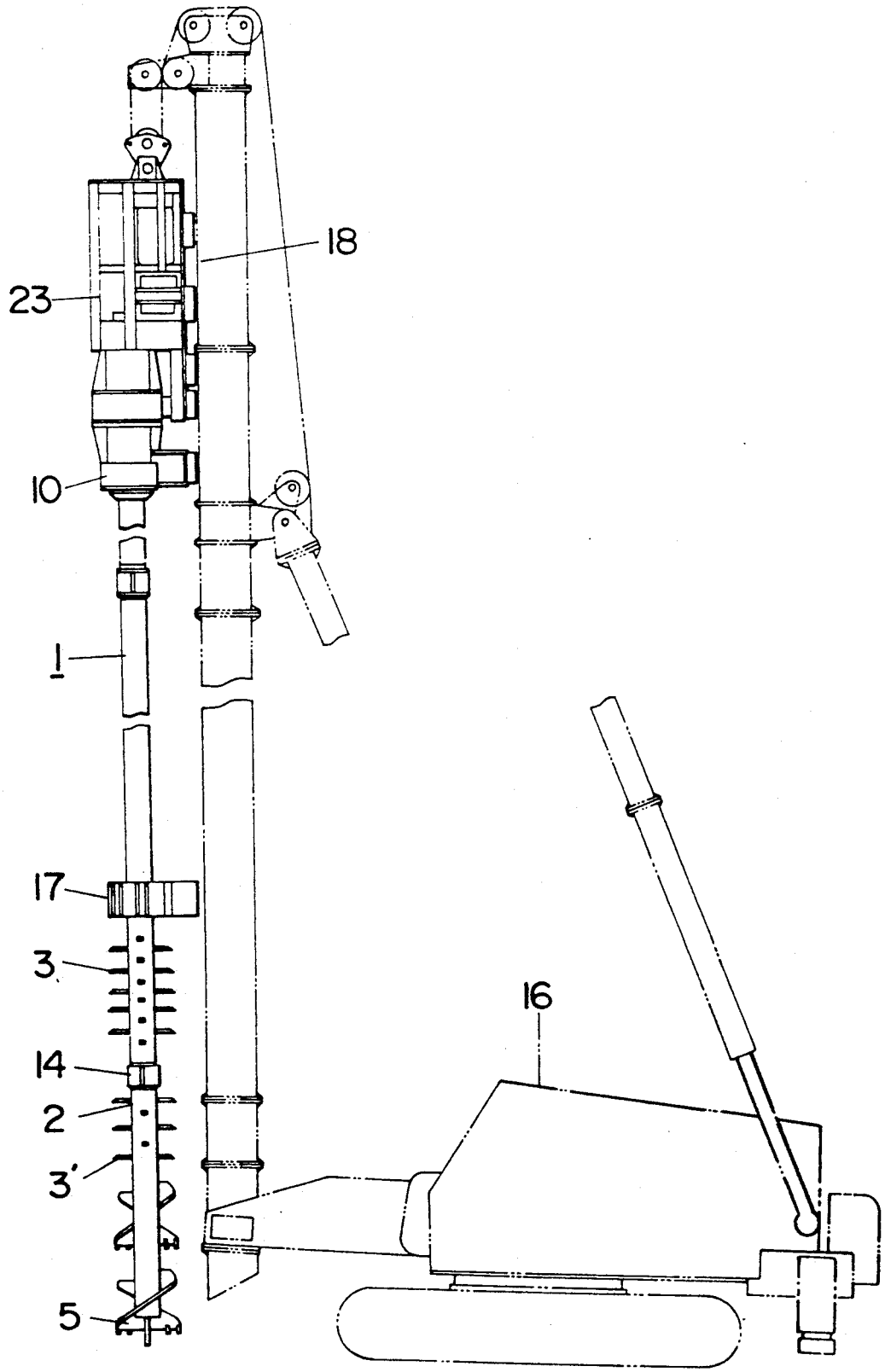
FIG. 1 is a partially cut-out front view of one embodiment of the present invention.
Figure 2:
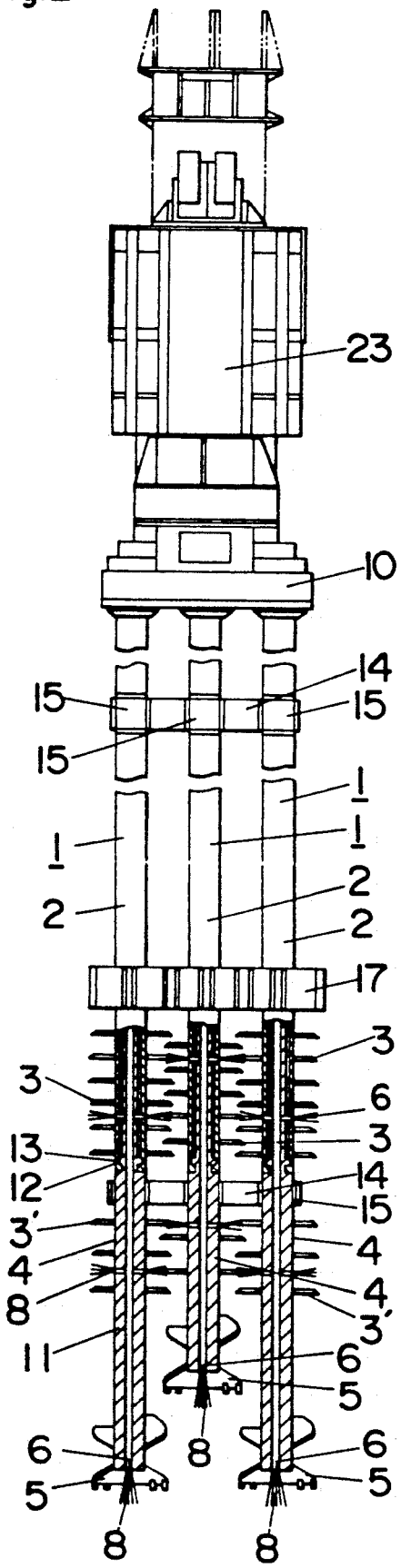
FIG. 2 is a side view thereof.
Figure 3:
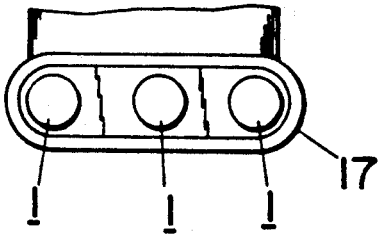
FIG. 3 is a plan view showing a swing prevention device thereof.

FIGS. 1 through 3 show one embodiment of a double-tube type boring and kneading machine according to the present invention. An outer tubular shaft 2 is externally fitted to the external circumferential surface of an inner shaft 4 so as to form a double-tubular shaft assembly 1. The inner shaft 4 and the outer tubular shaft 2 are adapted to be separately rotated to each other. The outer tubular shaft 2 has stirring and kneading means 3 installed to the external surface thereof along the wholelength or at the portions in the vertical length thereof. The inner shaft 4 has a boring bit 5 installed to the leading end thereof and is provided with lower stirring and kneading means 3'. Herein, the double tubular shaft assemblies 1 are arranged so that portions of the rotation orbits described by the stirring and kneading means 3 of the adjacent double-tubular shaft assembies 1 as well as portions of the rotation orbits described by the lower stirring and kneading means 3' overlap to each other in a plan view. According to such a construction, the dug soils and sands and the binding liquid can be uniformly stirred and kneaded in the lateral direction.

The inner shaft 4 is provided at its side with liquid discharge ports 6, and the outer tubular shaft 2 are provided at its lower portion with liquid discharge ports 6. A double-tube type boring and kneading machine comprises a plurality of double tubular shaft assemblies 1 having the above-mentioned construction. The respective double tubular shaft assemblies 1 are connected at their upper portions to a multi-spindle device 10. A rotational force is transmitted from a drive device 23 such as a prime mover to the multi-spindle device 10, so that the outer tubular shaft 2 of each double tubular shaft assembly 1 can be rotated at a high speed and the inner shaft 4 thereof can be rotated with a large torque by a transmission mechanism provided in the multi-spindle device 10.

Figure 4:
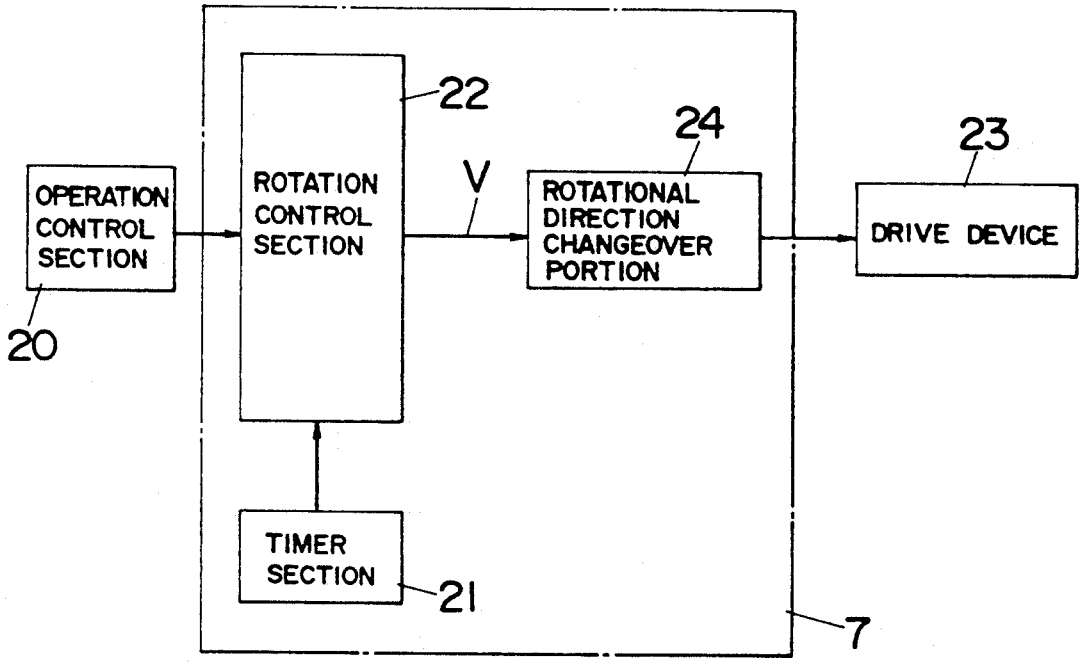
FIG. 4 is a block diagram showing a construction of a means for controlling the rotaional direction of a drive device by means of a rotational direction changeover control means thereof.

Then, the double tubular shaft assembly 1 will be further explained. The inner shaft 4 is provided at its lower side with a large diameter portion 11 having the same diameter as that of the outer tubular shaft 2. This large diameter portion 11 is projected downward below the outer tubular shaft 2 and provided with the boring bit 5. The inner shaft 4 is provided with an engaging lug 12 adapted to be engaged with a concave groove 13 formed in the inner surrounding surface of the outer tubular shaft 2 so that the rotational force can be transmitted thereto. The symbol 14 in the figure designates a connection member for connecting the outer tubular shaft assemblies 2 to one another or the inner shafts 4 to one another so as to prevent the distance between both double tubular shaft assembies 1 from enlarging or narrowing. A bearing portion 15 is rotatably loosely fitted to the outer tubular shaft 2 or to the inner shaft 4. The symbol 16 in the figure designates a crawler crane, and the symbol 17 designates a swing prevention means disposed on the lower portion of a rail 18 of the crawler crane 16. A plurality of double tubular shaft assemblies 1 are adapted to vertically move through the swing prevention means 17. In the double-tube type boring and kneading machine having the above-mentioned construction according to the present invention there is provided a rotational direction changeover control means 7 for controlling the rotational direction of the double tubular shaft assembly 1 so as to be reversely rotated periodically. FIG. 4 is a block diagram showing a construction of the means for controlling the rotational direction of a drive device 23 by means of the rotational direction changeover control means 7. The rotational direction changeover control means 7 comprises an operation section 20 composed of operation switches such as a rotation start switch, a rotaion stop switch, an emergency stop switch, a timer setting switch and so on, a timer section 21 to set a time for automatically reversing the rotational direction, a rotation control section 22 to output a rotational direction control signal V depending on the outputs of the operation section 20 as well as of the timer section 21, and a rotational direction changeover section 24 composed of a relay which changes over the rotational direction of the drive device 23 depending of the rotational direction control signal V. The rotational direction of the drive device 23 is adapted to be changed over every certain period of time set in the timer section 21 so as to change the rotational direction of each double tubular shaft assembly 1 and then to continue the rotation thereof. In the above-mentioned block diagram, the rotational directon changeover control means 7 comprises the timer section 21, the rotation control section 22 and the rotational direction changeover section 24. In this embodiment, both the outer tubular shaft 2 and the inner shaft 4 of the double tubular shaft assembly 1 rotate in the same direction. When the rotation of the drive device 23 is automatically reversed after a certain period of time, both the outer tubular shaft 2 and the inner shaft 4 reversely rotate together. Of course, according to the present invention, the outer tubular shaft 2 and the inner shaft 4 may be set up so as to rotate in the opposite directions to each other by automatically reversely operating the drive device 23 after a certain period of time.

The double-tube type boring and kneading machine having the above-mentioned construction is adapted to rotate the inner shaft 4 with a large torque as well as to rotate the outer tubular shaft 2 at a high speed while a plurality of double tubular shaft assemblies 1 vertically movably passing through the swing prevention means 17 are lowered. While the inner shaft 4 is rotated with a large torque discharging the binding liquid 8 such as a cement milk and the like from the ports 6, the foundation ground is bored by means of the boring bit 5 thereof. The dug soils and sands and the binding liquid 8 are stirred and kneaded by means of the lower stirring and kneading means 3' of the inner shaft 4 rotating with a large torque (namely, usually a rotational speed becomes lower as a larger torque rotation is performed) by means of the stirring and kneading means 3 of the outer tubular shaft 2 rotating at a high speed. In this case, when the inner shaft 4 rotating with a large torque is adapted to be rotated at a low speed by the outer tubular shaft 2, the low speed stirring and kneading and the high speed stirring and kneading are simultaneously carried out by the stirring and kneading means 3 provided in the inner shaft 4 rotating at a low speed and by the lower stirring and kneading means 3' provided in the outer tubular shaft 2 rotating at a high speed respectively. The binding liquid 8 spouted downward serves to break the foundation ground below the boring bit 5. Thereupon, since the inner shaft 4 is rotated with a large torque, the boring capability is so increased that the weak ground as well as the solid ground can be surely bored. Incidentally, since the above-mentioned embodiment is provided with the rotational direction changeover control means 7 which controls the double tubular shaft assemblies 1 separately rotating to one another to reversely rotate periodically, the double tubular shaft assemblies 1 are separately reversely rotated to one another periodically during mixing of the binding liquid 8 such as the cement milk and the soils and sands. By reversely rotating the double tubular shaft assemblies 1 periodically by means of the rotational direction changeover control means 7 in that way, both the solid ground and the weak ground can be continuously and uniformly stirred and kneaded. Thus, the improvement of the foundation ground is attained by forming a wall having a substantially rectangular cross-section in the ground. Further, a mountain anchoring means can be formed by continuously arranging a plurality of such walls in the foundation ground.

Figure 5:
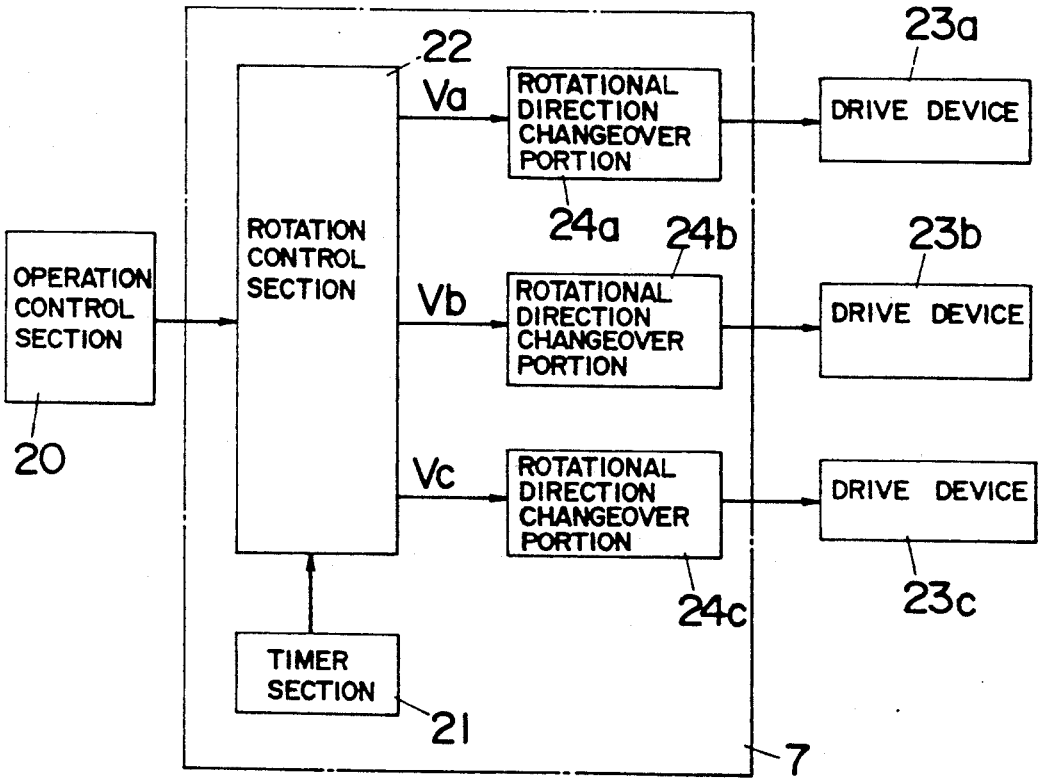
FIG. 5 is a block diagram showing another embodiment of the means for controlling the rotational direction of the drive device by means of the rotational direction changeover control means thereof.

Besides the above-mentioned embodiment in which the upper portion of each double tubular shaft assembly 1 is attached to the multi-spindle device 10 so that the outer tubular shaft 2 of the double tubular shaft assembly 1 can be rotated at a high speed and the inner shaft 4 can be rotated with a large torque through a transmission mechanism disposed near the multi-spindle device 10, the double tubular shaft assemblies may be separately rotated respectively by means of individual drive devices 23 through the transmission mechanisms so that the outer tubular shafts 2 can be rotated at a high speed and the inner shafts 4 can be rotated with a large torque. FIG. 5 shows a block diagram explaining a construction of a rotary drive means of this another embodiment. This embodiment employs three sets of double tubular shaft assemblies 1 arranged side by side to one another and is adapted to change over the rotational directions of the respective drive devices 23 by changing over the respective rotational direction changeover portions 24*a*, 24*b*, 24*c* in dependence on rotational direction control signals Va, Vb, Vc outputted from the rotation control section 22 depending on the outputs of the operation section 20 as well as of the timer section 21.

Figure 6:
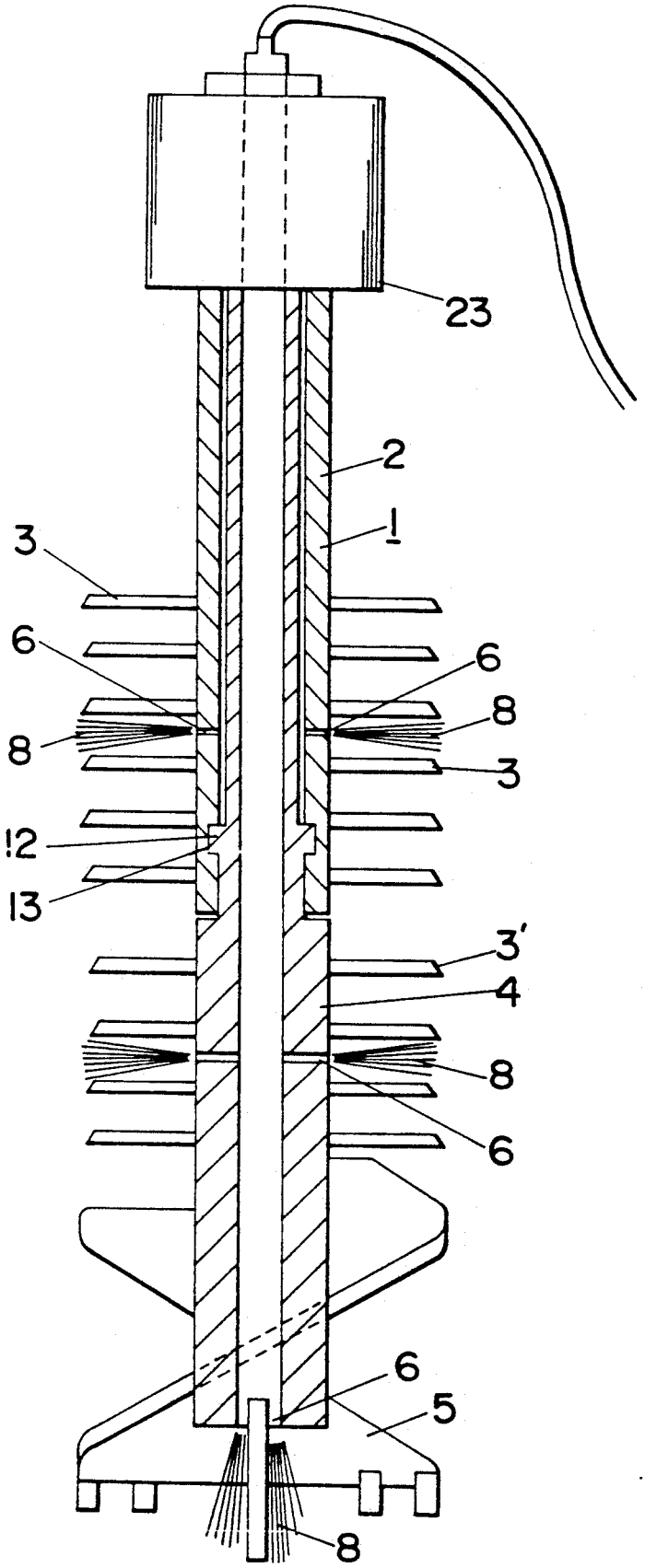
FIG. 6 is a sectional view showing another embodiment of the present invention.

Besides the above-mentioned embodiments in which the double-tube type boring and kneading machine employs a plurality of double tubular shaft assemblies 1, the double-tube type boring and kneading machine may comprise one set of double tubular shaft assembly 1 as shown in FIG. 6.

On one hand, according to the present invention, an effective stirring and kneading can be carried out by rotating the high speed stirring and kneading menas 3 and the low speed stirring and kneading means 3' in the opposite directions to each other.

Further, in the case that the inner shaft 4 has the liquid discharge ports 6 formed at the side in the lower portion thereof and the outer tubular shaft 2 has the liquid discharge ports 6 formed at the side thereof, the boring against the foundation ground is facilitated by the binding liquid 8 spouted from these ports 6 of the inner shaft 4. Further, in the case that the inner shaft 4 is provided with the stirring and kneading means 3', the binding liquid 8 may be directly discharged to the dug soils and sands to be stirred by the stirring and kneading means 3' so that the stirring and kneading can be well carried out. And the binding liquid 8 is directly discharged from the ports 6 of the outer tubular shafts 2 so that the dug soils and sands and the binding liquid 8 can be more effectively stirred and kneaded.

Incidentally, as the stirring and kneading means 3 and the lower stirring and kneading means 3' according to the present invention, various kinds of means such as a wing type one and a screw type one may be utilized.

Figure 7:
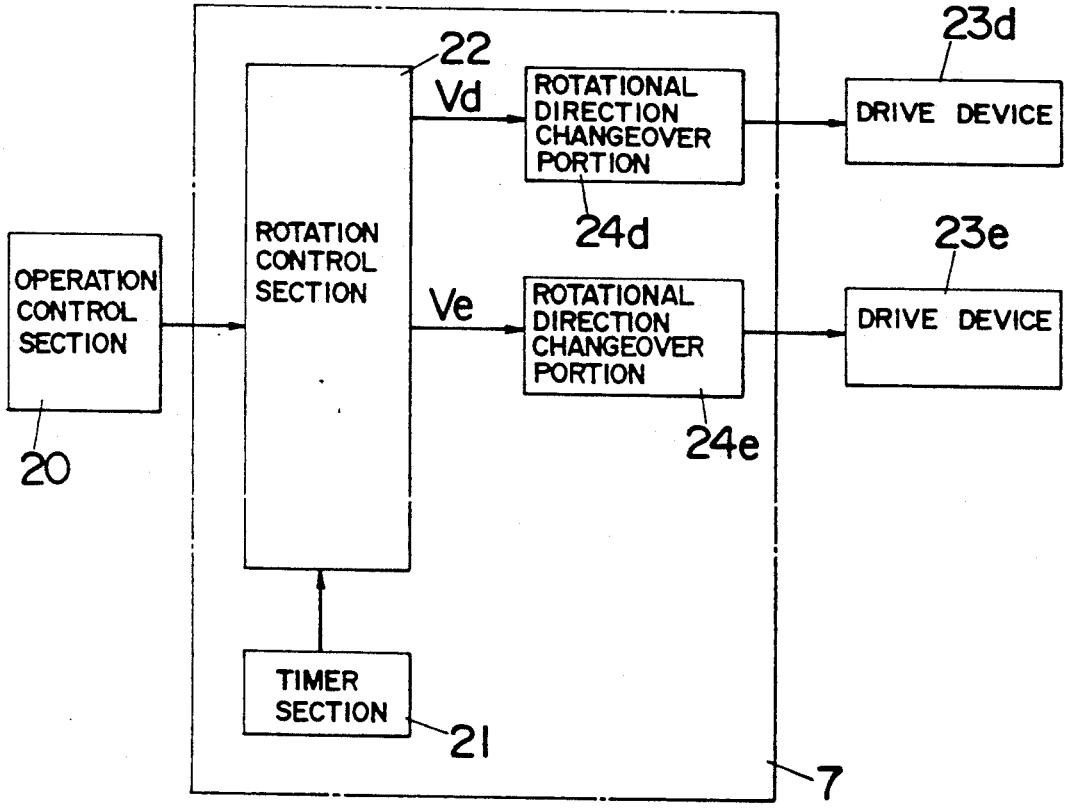
FIG. 7 is a block diagram showing a construction of the means for controlling the rotational direction of the drive device by means of the rotational direction changeover control means of further another embodiment of the present invention.

On the other hand, though the above-mentioned respective embodiments employ both the outer tubular shaft 2 and the inner shaft 4 of the double tubular shaft assembly 1 adapted to be driven by means of the same drive device 23 through the transmission mechanism as explained above, the outer tubular shaft 2 and the inner shaft 4 of the double tubular shaft assembly 1 may be separately driven by means of individual drive devices 23*a*, 23*b* respectively. In this case, as shown in FIG. 7, the rotation control section 22 is adapted to output the rotational direction control signals Vd, Ve for the respective drive device 23*a*, 23*b* depending on the outputs of the operation section 20 and of the timer section 21, and the rotational direction changeover portions 24*d*, 24*e* are adapted to be changed over depending on the rotational direction control signals Vd, Ve so as to change over the rotational directions of the respective drive devices 23*a*, 23*b*.

As noted above, according to the present invention, since the double tubular shaft assembly having the outer tubular shaft and the inner shaft separately rotatable to each other has the stirring and kneading means disposed at the external surface of the outer tubular shaft rotating at a high speed as well as has the boring bit disposed at the leading end of the inner shaft rotating with a large torque, the lower stirring and kneading means and the liquid discharge ports provided at the side thereof, not only the weak ground but also the solid ground can be bored by means of the inner shaft rotating with a large torque. When the dug soils and sands and the binding liquid are stirred and kneaded, a compound stirring and kneading operation composed of the high speed stirring and kneading performed by the stirring and kneading means of the outer tubular shaft rotating at a high speed and the low speed stirring and kneading performed by the lower stirring and kneading means of the inner shaft rotating with a large torque can be effectively carried out so that both the weak and the solid grounds can be continuously and uniformly stirred and kneaded and simultaneously improved.

Further, in case that the outer tubular shaft having the stirring and kneading means are provided with the liquid discharge ports, the binding liquid is discharged not only from the ports of the inner shaft but also from the ports of the outer tubular shaft. Therefore, the dug soils and sands can be effectively stirred and mixed, so that both the weak and the solid grounds can be continuously and uniformly stirred and kneaded, and improved at once.

In case that there is provided the rotational direction changeover control means for controlling the double tubular shaft assembly to reversely rotate periodically, the stirring and kneading operation can be carried out automatically in the reverse direction every certain period of time so that both the solid and the weak grounds can be continuously uniformly stirred and kneaded and simultaneously improved.

In case that there are provided a plurality of double tubular shaft assemblies, both the weak and the solid grounds can be continuously uniformly stirred and kneaded so that a large area can be improved. In this case, when the adjacent double tubular shafts are so set that portions of the orbits described by the stirring and kneading means as well as portions of the orbits described by the lower stirring and kneading means overlap to each other in a plan view, a more uniform stirring and kneading operation can be carried out.

In addition, according to the method of the present invention, the improvement of the foundation ground having the above-mentioned characteristics can be readily attained.

What is claimed is:

1. A double-tube type boring and kneading machine comprising a double tubular shaft assembly composed of both an outer tubular shaft and an inner shaft separately rotatable to each other, said outer tubular shaft being adapted to be rotated at a high speed and provided at its external surface with a stirring and kneading means, and said inner shaft being adapted to be rotated with a large torque and provided with a boring bit at its leading end, a lower stirring and kneading means and a liquid discharge port, wherein said lower stirring and kneading means is spaced axially upwardly from said boring bit in such a manner as to stir and knead the mixture of the soil and liquid discharged from said liquid discharge port at a low torque rotation of said inner shaft.

2. A double-tube type boring and kneading machine as defined in claim 1, wherein said outer tubular shaft having the stirring and kneading means is provided with a liquid discharge port.

3. A double-tube type boring and kneading machine as defined in claim 1 or 2, wherein there is further provided a rotational direction changeover control means for rotating said double tubular shaft assembly in the reverse direction periodically.

4. A double-tube type boring and kneading machine as defined in claim 1 or claim 2, wherein there are provided a plurality of double tubular shaft assemblies.

5. A double-tube type boring and kneading machine as defined in claim 4, wherein said stirring and kneading means and said lower stirring and kneading means define orbits when said outer tubular shafts and said inner shaft are rotated, and wherein portions of the orbits described by the stirring and kneading means of the adjacent double tubular shaft assemblies as well as portions of the orbits described by the lower stirring and kneading means thereof overlap each other in a plan view.

6. A method for improving a foundation ground by employing a double-tube type boring and kneading machine, which machine comprising a double tubular shaft assembly composed of both an outer tubular shaft and an inner shaft separately rotatable to each other, said outer tubular shaft being adapted to be rotated at a high speed and provided at its external surface with a stirring and kneading means, and said inner shaft being adapted to be rotated with a large torque and provided with a boring bit at its leading end, a lower stirring and kneading means and a liquid discharge port, wherein said lower stirring and kneading means is spaced axially upwardly from said boring bit in such a manner as to stir and knead the mixture of the soil and liquid discharged from said liquid discharge port at a low torque rotation of said inner shaft, which method comprising a boring step for boring a foundation ground by spouting the binding liquid such as a cement milk and the like at a high pressure thereinto from the port of the double-tube type boring and kneading machine, and mixing and kneading step for mixing the binding liquid such as the cement milk and the like spouted into the ground with soils and sands and kneading them by means of said stirring and kneading means of the outer tubular shaft as well as said lower stirring and kneading means of the inner shaft.

7. A method for improving a foundation ground by employing a double-tube type boring and kneading machine as defined in claim 6, wherein said liquid discharge port is formed not only in the inner shaft but also in the outer tubular shaft so that the binding liquid can be discharged from the ports of both the inner shaft and the outer tubular shaft while the foundation ground is bored by means of the double-tube type boring and stirring machine and the dug soils and sands and the binding liquid are mixed and kneaded in the ground.

8. A method for improving a foundation ground by employing a double-tube type boring and kneading machine as defined in claim 6 or claim 7, wherein said double tubular shaft assembly is adapted to be rotated in the reverse direction periodically while the foundation ground is bored by means of the double-tube type boring and kneading machine and the binding liquid and the soils and sands are mixed and kneaded in the ground.

9. A double-tube type boring and kneading machine as recited in claim 1, wherein said lower stirring and kneading means and said stirring and kneading means each comprise a plurality of blades, and said blades of said lower stirring and kneading means are similar in size and shape to said blades of said stirring and kneading means.

* * * * *